United States Patent [19]

Mimura et al.

[11] Patent Number: 4,777,099

[45] Date of Patent: Oct. 11, 1988

[54] THIN-FILM EL DEVICE

[75] Inventors: Yoshiyuji Mimura; Yasuo Isono, both of Tokyo, Japan

[73] Assignee: Olympus Optical Co., Ltd., Tokyo, Japan

[21] Appl. No.: 103,188

[22] Filed: Sep. 30, 1987

[30] Foreign Application Priority Data

Oct. 3, 1986 [JP] Japan ..... 61-236011

[51] Int. Cl.[4] ..... H05B 33/12

[52] U.S. Cl. ..... 428/690; 428/691; 428/917; 313/503; 313/509

[58] Field of Search ..... 313/509, 503; 428/690, 428/691, 917

[56] References Cited

U.S. PATENT DOCUMENTS

| | | | |
|---|---|---|---|
| 3,274,024 | 9/1966 | Hill et al. | 313/509 X |
| 4,405,691 | 9/1983 | Yale | 428/690 |
| 4,431,922 | 2/1984 | Patten | 428/690 X |
| 4,499,159 | 2/1985 | Brines et al. | 428/690 X |

FOREIGN PATENT DOCUMENTS

| | | | |
|---|---|---|---|
| 1543233 | 3/1979 | United Kingdom | 428/917 |

OTHER PUBLICATIONS

IEEE Transactions on Electron Devices, vol. ED-31, No. 1, Jan. 1984 "Choice of Dielectrics for TFEL Displays".

Japanese Journal of Applied Physics, vol. 21, No. 7, Jul., 1982, pp. 1028-1031 "TFEL Device Employing $TA_2O_5$ Insulator".

*Primary Examiner*—Nancy A. B. Swisher

*Attorney, Agent, or Firm*—Frishauf, Holtz, Goodman & Woodward

[57] ABSTRACT

A thin-film electroluminescence device comprises a plate-like transparent electrode formed on a transparent substrate. A first insulating layer is formed on the transparent electrode. A second insulating layer is mounted on an electroluminescent layer made of ZnS:Mn and formed on the first insulating layer. A plate-like back electrode is provided on the second insulating layer. The first and second insulating layers are each made of gadolinium oxide of a purity level of over 99.9% and have a thickness of 0.05 to 0.8 μm.

19 Claims, 3 Drawing Sheets

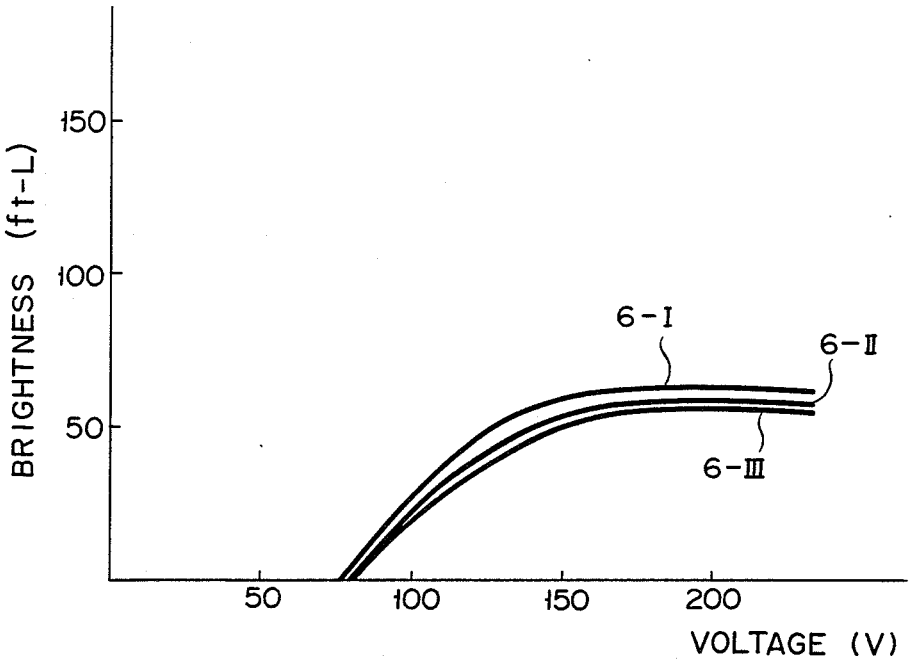
FIG. 6 (PRIOR ART)
FIG. 7
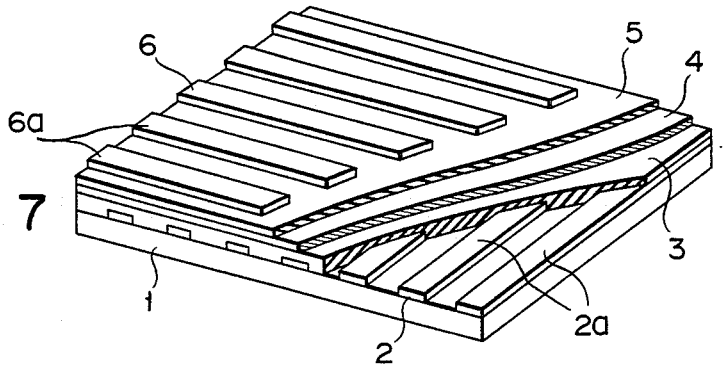
FIG. 8
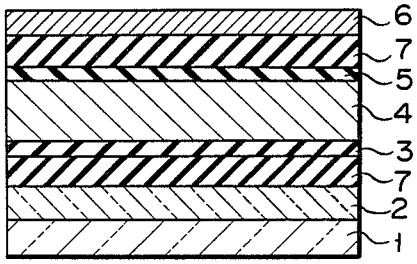

THIN-FILM EL DEVICE

BACKGROUND OF THE INVENTION

This invention relates to an electroluminescence device (thin-film EL device) including a pair of electrodes for voltage application and having an insulating layer formed along and on one side of an EL emission layer or a fluorescent layer.

Widely known is a thin-film EL device of a double layer insulation structure which has been manufactured through the formation of a thin film made of fluorescent material, such as ZnS:Mn, by a means of an electron beam evaporation or a sputting method and the formation of a thin insulating layer, such as $Al_2O_3$, $Ta_2O_5$, $BaTiO_3$, $PbTiO_3$, $SrTiO_3$, $Y_2O_3$ or $Sm_2O_3$, at each side of the fluorescent film.

The thin-film EL devices have recently been used for a display for industrial measuring instruments and laptop personal computers, in view of their excellent visual recognition property.

As an insulating material for thin-film EL elements use is made of one having a high relative performance and high luminance in view of the withstand voltage property, relative permittivity, film formation property, property of a close bond to the associated film.

Among various insulating materials, $Y_2O_3$ is used as such an insulating material as disclosed in IEEE-Transactions on Electron Devices Vol. ED-31, No. 1, Jan. 1984 and $Sm_2O_3$is employed as such an insulating material as disclosed in J. Applied Phys. Vol 21, 1982, P 1028.

However, the conventional thin-film EL devices have various drawbacks as set out below.

$Al_2O_3$, if employed as such an insulating material, can relatively readily be formed, as a single film, on the associated film structure by means of a sputtering or an electron beam evaporation method, but if formed as an EL layer on, for example, a ZnS, CaS or SrS film structure, $Al_2O_3$ manifests a poor affinity for these materials and, at the time of film formation, the peeling of one film from the associated film. Even if no peeling takes place at that time, it does occur due to the light emission aging and the consequent poor bonding force involved. In order to eliminate such a drawback, an attempt is made to interpose an intermediate layer, such as $Si_3N_4$, between the $Al_2O_3$ layer and the ZnS layer, requiring more manufacturing steps and more complicated steps and hence a higher cost.

Furthermore, the use of $Al_2O_3$ does not necessarily assure any adequate threshold voltage nor high luminance at the initial luminance level.

Upon the light emission aging, the device reveals a greater (i.e. 60 to 70 V) shift of the emission start voltage toward a high voltage side in unstable fashion.

In the case of $Ta_2O_5$, the device shows almost no shift of emission start voltage resulting from the emission aging, but is somewhat lower in its luminance level and, moreover, is liable to produce dielectric breakdown.

In addition to this, if the dielectric breakdown mode, though dependent from the manufacturing method, is of a propagation type, it is propagated into not only one spot in the device but also many other parts. As a practical solution to this problem a composite $SiO_2$ layer structure is employed, but the manufacturing steps are very complicated and higher in costs.

If $Al_2O_3$ or $Ta_2O_5$is formed as a film on the ITO transparent electrode, it is liable to lose its transparence due to the development of color in that film.

When use is made as an insulating layer of $BaTiO_3$, $PbTiO_3$, $Y_2O_3$or $Sm_2O_3$, then it is very difficult to control the composition of the insulating materials. In this case, more time and more manufacturing steps are required in the setting of the parameters in an attempt to form films of better quality because of a greater fluctuation among the parameters.

SUMMARY OF THE INVENTION

It is accordingly the object of this invention to provide a thin-film EL device which is relatively easy in manufacture, high in emission efficiency and luminance level, stable in characteristics, durable and longer in service life.

According to this invention, a thin-film EL device is provided which includes a pair of electrodes for voltage application and at least one insulating layer formed along and on the side of an EL emission layer, wherein gadolinium oxide is employed as the insulating layer.

The gadolinium oxide layer is higher in threshold voltage and of a self-restoring type in a dielectric breakdown mode and, furthermore, higher in a strength of its bond to other materials and adequately high in transparence to allow it to be properly used for the EL device.

It is therefore possible to provide a thin-film EL device which is excellent in emission characteristics and durable in addition.

BRIEF DESCRIPTION OF THE DRAWINGS

FIGS. 5 and 6 each show the emission characteristic curves of a conventional EL device as distinct from that of FIG. 4;

FIG. 7 is a perspective view showing a thin-film EL device according to a second embodiment of this invention; and FIG. 8 is a cross-sectional view showing a thin-film EL device according to a third embodiment of this invention.

DETAILED DESCRIPTION OF THE PREFERRED EMBODIMENTS

The embodiment of this invention will be explained below with reference to the accompanying drawings.

Figure 1:
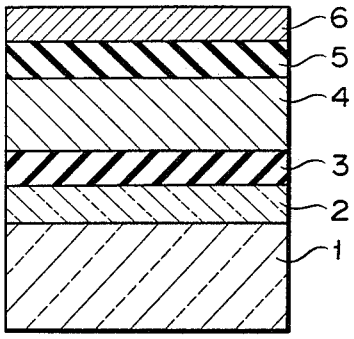
FIG. 1 is a cross-sectional view showing a thin-film EL device according to one embodiment of this invention.

In an EL device shown in FIG. 1, plate-like transparent electrode 2, first insulating layer 3, EL layer 4, second insulating layer 5 and plate-like back electrode 6 are formed in that order on transparent substrate 1 to provide a so-called double insulating layer structure. First and second insulating layers 3 and 5 are formed of gadolinium oxide. It is preferable that the gadolinium oxide here used has a purity of over 99.99% not containing any impurity, such as Fe and Ni. This is because Fe and Ni act as an emission layer killer and because other impurities exert a bad influence over the insulating property.

Embodiment 1

Transparent electrode 2 was formed on transparent substrate (trade name: Corning 7059) 1 by means of a vapor deposition or a sputtering method.

Powdered $Gd_2O_3$ of 99.999% purity (five nines), after being molded under pressure, was sintered in the atmosphere of $N_2$ at 700° C. for 3 hours to prepare an electron-beam evaporated target of 20 mm in diameter × 5 mm in thickness.

A 0.5 μm-thick $Gd_2O_3$ film was formed as first insulating film 3 on transparent electrode 2 by the electron beam evaporation method with the use of the aforementioned target. At this time, the film was formed under the following conditions:

substrate temperature: 200° C.
partial $O_2$ pessure: $1\times10^{-4}$ Torr
acceleration voltage: 6 kV
beam current: 40 mA Then a composition ZnS:Mn containing 0.5% by weight of Mn was electron beam-evaporated to form fluorescent layer 4 of 0.5 μm in thickness. Then a $Gd_2O_3$ film was formed as second insulating layer 5 on EL layer 4 under the same conditions as in the formation of aforementioned first insulating layer 3. The resultant structure was annealed in vacuum at 300° C. for 2 hours and no peeling of the film was revealed upon close observation. Aluminum was vacuum-evaporated as back electrode 6 on second insulating film 5 to provide a thin-film EL device.

Figure 4:
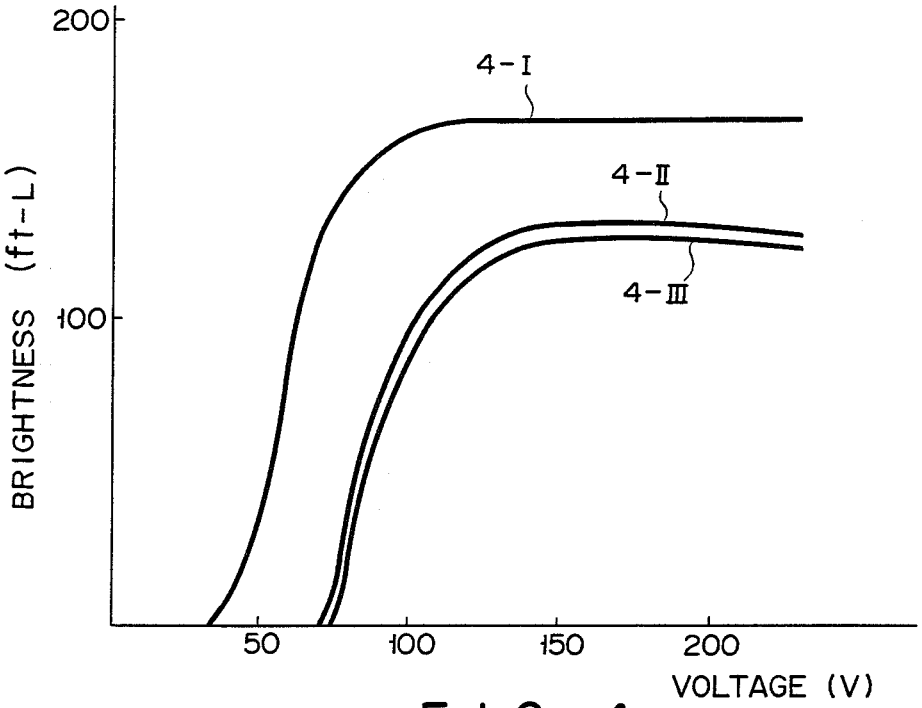
FIG. 4 shows a graph showing the emission characteristic curve of the EL device according to the present invention.

The voltage-luminance characteristic of the thin-film EL device was examined upon the application of sinusoidal alternating voltage of 50 Hz to the EL device. From this it has been found that the emission starts at 50 V, when the voltage is slowly raised. As a result, at the voltage level of over 100 V a very high luminance level of 160 ft-L is shown as appreciated from the characteristic curve 4-1 in FIG. 4. At the accelera-tion withstand test of 4 KHz at 60° C. a high luminance level was obtained, as indicated by the characteristic curve 4-II in FIG. 4, after 5 hours following the operation of the device, in which case there occurred neither the peeling of the film nor dielectric breakdown. After 1000 hours, the emission start voltage and luminance level hardly vary as indicated by the characteristic curve 4-III upon comparison with the operation of the device after 5 hours.

Control 1

Figure 5:
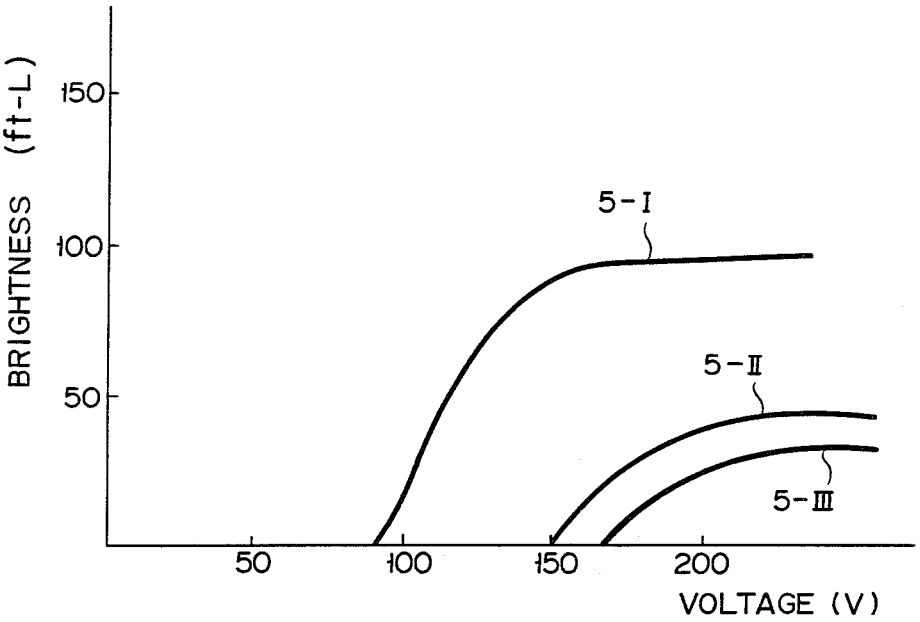
FIG. 5 (PRIOR ART)

A 0.5 μm -thick $Al_2O_3$ insulating film was formed by an electron beam evaporation method on an ITO film overlying a glass substrate of Corning 7059. At this time the resultant structure appeared faintly purpla owing to the reaction of $Al_2O_3$ with ITO. An EL layer and second insulating layer were further formed on the structure under the same conditions as in Example 1. In this way, 10 devices were prepared among which four devices were found damaged due to the peeling developed between the ZnS layer and $Al_2O_3$ layer. The back electrode of aluminum was formed on the undamaged devices and evaluation was made as in Example 1. It has been found that, at the start of emission at 90 V, the luminance level at 90 V is very low on the order of 15 ft-L as indicated by the characteristic curve 5-I in FIG. 5. Furthermore, the acceleration withstand tests were conducted at 4 Khz and 60° C. for the six undamaged samples and it has been found that, at the withstand test of 5 hours as indicated by the characteristic curve 5-II in FIG. 5, three of them reveal peeling of their films. For the remaining three undamaged samples, a rise of emission start voltage and a fall of the luminance level were obviously observed, after 1000 hours, as indicated by the characteristic curve 5-III.

Control 2

A 0.05 μm -thick $SiO_2$ film was formed by a high-frequency sputtering method on an ITO film overlying a glass substrate of Corning 7059, in which case use was made, as the substrate temperature, of 50° C. This was done in order to prevent a coloring reaction from being produced between $Ta_2O_5$and ITO. Then a composition ZnS:Mn layer was electron beam-evaporated under the same condition as in Example 1 and a 0.5 μm -thick $Ta_2O_5$was formed as a second insulating layer.

The resultant structure was annealed in vacuum at 2 hours at 300° C. and aluminum was evaporated, as a back electrode on the structure to yield a thin-film EL device as Control 2.

For the voltage-luminance characteristic of the device, the luminance level was low on the order of 25 ft-L at 100 V as indicated by the characteristic curve 6-I in FIG. 6.

The acceleration withstand tests were carried out as set forth above to obtain the characteristic curve 6-II for 5 hours' withstand tests and the characteristic curve 6-III for 100 hours' withstand tests. From this it has been found that a variation of the emission start voltage, as well as a fall in the luminance level, is appreciably never observed, but seven of 10 samples under the identical conditions were found damaged due to the propagation type dielectric breakdown of the back electrode.

Embodiment 2

With the use of a sintered target containing a $Gd_2O_3$ film of 99.999% impurity, 0.5 μm -thick $Gd_2O_3$ film (insulating film) 3 was formed by a high-frequency sputtering method or painting method on transparent electrode 2 (ITO glass substrate) overlying transparent substrate 1.

The sputtering conditions were such that, at the time of controlling gas pressure, $O_2Ar=\frac{1}{4}$ at a pressure of $4\times10^{-4}$ Torrs and that, at the time of sputtering, use was made as a gas pressure of $5\times10^{-2}$ Torrs at a high-frequency power of 120 W and substrate temperature of 50° C.

The ITO glass 2 here employed is of such a type that a group of five stripe electrodes **2*a*** per 1 mm is cyclically formed by etching.

A composition ZnS:Mn was evaporated in vacuum on the surface of the structure in the atmosphere of Zn, S and Mn to form 0.5 μm-thick EL layer 4. Then the resultant structure was annealed in vacuum for 30 minutes at 400° C. to give a ZnS:Mn structure.

$Gd_2O_3$ film was formed as second insulating layer 5 on emission layer 4 by the high-frequency sputtering method and the resultant structure was annealed in vacuum for 2 hours at 300° C. A dark-brown composite In/Al oxide layer was formed as back electrode 6 on the structure by the high-frequency sputtering method followed by an etching step. In this case, a group of five stripe electrodes **6*a* per 1 mm was cyclically formed by the etching step in a direction perpendicular to the underlying stripe ITO electrode group 2*a* to provide an X-Y matrix-like thin-film EL device as shown in FIG. 7**. The resultant structure was subjected to wire interconnection. The device thus obtained was operated in an X-Y matrix fashion, revealing a better luminance characteristic. teristic.

The withstand test was conducted through the forcible application of a voltage (230 V) higher than an ordinary operation voltage. It has been found that dielectric breakdown was developed in some lots but was localized without propagation.

Embodiment 3

Although, in the aforementioned embodiment, insulating layers 3 and 5 of gadolinium oxide were formed one between EL layer 4 and electrode 2 and one between EL layer 4 and electrode 6, two insulating layers 7, other than gadolinium oxide may be added as shown in FIG. 8. In this case, gadolinium oxide layers 3, 5 are formed to directly contact with the EL layer 4 so that these layers 3, 5 can be highly bonded to emission layer 4.

This invention is not restricted to the aforementioned embodiments and can be changed or modified without the sprit and scope of this invention.

Figure 2:
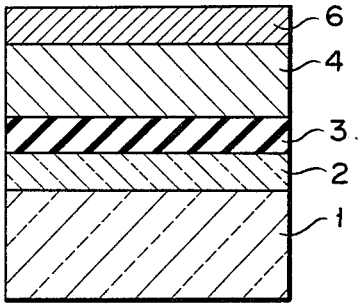
FIGS. 2 and 3 are cross-sectional views each showing a varied form of the EL device.
Figure 3:
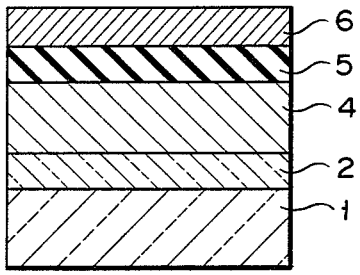

Although a double insulation layer structure has been explained in connection with the embodiment of FIG. 1, only one insulation layer structure may be configured in which case the insulation layer is located on one side of EL layer 4 to provide an MIS structure as shown in FIGS. 2 and 3.

In the EL device of this invention it is preferable that the gadolinium oxide layer (insulating layer) has a purity level of 99.9% and that the insulating layer above have a thickness of 0.2 to 0.8 μm (average thickness: 5 μm ) for the first embodiment and 0.05 to 0.3 μm for the third embodiment.

The thin-film EL device of this invention has the following advantages:

(1) A high luminance level may be obtained at low voltage and at the time of "aging" the emission threshold voltage reveals a small shift of 30 to 40 V.

(2) The gadolinium oxide shows a high bonding force for ZnS, CaS, SrS, glass, ITO and metal, for instance, and the device reveals an excellent uniformity of luminance on the emission surface at the time of conduction, as well as a high withstand capability.

(3) It is possible to assure a high breakdown voltage as in the case of $SiO_2$ and $Y_2O_3$and hence a long service life. Furthermore, since the dielectric breakdown mode is of a self-restoring type, the device can localize a dielectric breakdown, even if produced, when it is employed in the X-Y matrix device.

(4) An excellent overall performance can be obtained in terms of the withstand voltage, dielectric constant and bonding force with the use of a single insulating layer in place of a composite insulating layer. The device is relatively easy to manufacture and low in cost.

(5) It is possible to obtain a high transparency as well as a high external emission efficiency.

(6) Unlike the use of $PbTiO_3$and $Y_2O_3$, a greater allowance can be taken among the parameters at the time of forming films, so that a stable, uniform film can be formed at low cost.

What is claimed is:

1. A thin-film electroluminescence device comprising:

an electroluminescence layer;

first and second electrodes formed on both sides of the electroluminescence layer to apply voltage to the electroluminescene layer; and an insulating layer formed of gadolinium oxide and located between at least one of the first and second electrodes and the electroluminescence layer.

2. The thin-film electroluminescence device according to claim 1, wherein said gadolinium oxide has a purity level of over 99.9%.

3. The thin-film electroluminescence device according to claim 1, wherein said insulating layer has a thickness of 0.05 to 0.8 μm.

4. The thin-film electroluminescence device according to claim 3, wherein said insulating layer has a thickness of 0.2 to 0.8 μm.

5. The thin-film electroluminescence device according to claim 1, wherein said first electrode has a transparent electrode.

6. The thin-film electroluminescence device according to claim 1, wherein said first and second electrodes are each formed of a stripe electrode group such that the stripe electrode group of said first electrode extends in a direction perpendicular to that of said second stripe electrode group.

7. The thin-film electroluminescence device according to claim 1, further comprising a second insulating layer made of different material from that of the insulating layer and formed between said insulating layer and the electrode.

8. The thin-film electroluminescence device according to claim 7, wherein said second insulating layer has a thickness of 0.05 to 0.3 μm.

9. The thin-film electroluminescence device according to claim 1 wherein said gadolinium oxide insulating layer is in contact with said electroluminescence layer.

10. The thin-film electroluminescence device according to claim 9, wherein said gadolinium oxide has a purity level of over 99.99% and a thickness of 0.05 to 0.8 micron.

11. The thin-film electroluminescence device according to claim 10, wherein said insulating layer has a thickness of 0.2 to 0.8 micron.

12. The thin-film electroluminescence device according to claim 10, wherein said first electrode has a transparent electrode.

13. The thin-film electroluminescence device according to claim 12, wherein said first and second electrodes are each formed of a stripe electrode group such that the stripe electrode group of said first electrode extends in a direction perpendicular to that of said second stripe electrode group.

14. The thin-film electroluminescence device according to claim 10, further comprising a second insulating layer made of different material from that of said gadolinium oxide insulating layer and formed between said insulating layer and the electrode.

15. The thin-film electroluminescence device according to claim 14, wherein said second insulating layer has a thickness of 0.05 to 0.3 micron.

16. The thin-film electroluminescence device according to claim 9, further comprising a second insulating layer made of different material from that of said gadolinium oxide insulating layer and formed between said insulating layer and the electrode.

17. The thin-film electroluminescence device according to claim 16, wherein said second insulating layer has a thickness of 0.05 to 0.3 micron.

18. The thin-film electroluminescence device according to claim 9 wherein said gadolinium oxide has a purity level of over 99.99%.

19. The thin-film electroluminescence device according to claim 1 wherein said gadolinium oxide has a purity level of over 99.99%.

* * * * *